US006981292B1

(12) United States Patent
Dassi

(10) Patent No.: US 6,981,292 B1
(45) Date of Patent: Jan. 3, 2006

(54) CLEANING APPARATUS FOR HAIR BRUSHES AND COMBS

(76) Inventor: Francesco Dassi, Via Dellavecchia, 7, I-28100 Novara (IT)

( * ) Notice: Subject to any disclaimer, the term of this patent is extended or adjusted under 35 U.S.C. 154(b) by 332 days.

(21) Appl. No.: 10/089,660

(22) PCT Filed: Sep. 28, 2000

(86) PCT No.: PCT/IT00/00383

§ 371 (c)(1),
(2), (4) Date: Jun. 24, 2002

(87) PCT Pub. No.: WO01/22846

PCT Pub. Date: Apr. 5, 2001

(30) Foreign Application Priority Data

Sep. 29, 1999 (IT) ..... MI99A2026

(51) Int. Cl.
*A46B 17/06* (2006.01)

(52) U.S. Cl. ..... 15/38; 15/39; 15/311; 15/339

(58) Field of Classification Search ..... 15/311, 15/339, 38, 39
See application file for complete search history.

(56) References Cited

U.S. PATENT DOCUMENTS

| | | | | |
|---|---|---|---|---|
| 3,072,939 | A * | 1/1963 | Rehberg | 15/38 |
| 3,321,789 | A * | 5/1967 | Gundelfinger et al. | 15/38 |
| 3,348,253 | A | 10/1967 | McCoy | 15/38 |
| 3,805,318 | A | 4/1974 | Marquette | 15/311 |
| 4,403,364 | A * | 9/1983 | Schroeder | 15/38 |
| 6,367,120 | B2 * | 4/2002 | Beauchamp | 15/383 |
| 6,532,619 | B2 * | 3/2003 | Kasper et al. | 15/383 |

FOREIGN PATENT DOCUMENTS

| | | |
|---|---|---|
| NL | 9300585 | 11/1994 |

* cited by examiner

*Primary Examiner*—Theresa T. Snider
(74) *Attorney, Agent, or Firm*—Fay Kaplun & Marcin, LLP

(57) ABSTRACT

Described is an apparatus for removing hair entangled among the teeth of combs or the bristles of brushes, after their use, which acts through the action of rotating whips and of an assembly for sucking and collecting the removed residuals.

19 Claims, 8 Drawing Sheets

CLEANING APPARATUS FOR HAIR BRUSHES AND COMBS

BACKGROUND INFORMATION

As known, during combing with brushes or combs, it is easy and often unavoidable also in the healthiest hair that at the end of their use, these tools are not clean, and that hair remains entangled in their teeth or bristles.

At present, hair is mainly removed by rubbing two brushes with one another, a method not assuring a perfectly thorough hygiene (e.g. cleanliness and sterility) of the tools. There also exists a simple tool shaped as a small rake, whose curved metal teeth are inserted, where possible, among the brush bristles, and a device consisting of two idly-mounted parallel bristled rollers between which a comb, but not a brush, can be manually caused to slide thus obtaining a certain degree of cleaning. All of these methods do not perfectly clean, and they act with extreme slowness. Thus, cleaning brushes is boring, since much work is needed for obtaining visible results, and above all is unpleasant since none of the available devices takes care of collecting the removed residuals which, due to their volatility, are not even easy to locate.

This problem, which may be noticed also at home, is particularly felt by professional hairdressers due to the very frequent use of brushes and combs and the hygiene requirements imposed on them, as these are work tools intended for use with different people.

U.S. Pat. No. 3,348,253 describes a device for removing hair from a hair brush and/or a comb comprising two elongated brushes and rotating in opposite directions which comb the hair out of the hair brush into a lower hair receiving compartment.

Nederland Patent 9,300,585 and U.S. Pat. No. 3,805,318 describe apparatuses according to the preamble of claim 1, where however the rotating shaft/s is/are actually one/two bristled brush/es.

A brushing action implies a relevant friction force between a cleaning brush and an hair brush to be cleaned, causing i.a. both to become worn.

The problem at the basis of the present invention is that of eliminating the above disadvantages, by creating an apparatus for removing hair entangled among the teeth of combs or among the bristles of brushes, which should clean combs and brushes in an effective, fast and hygienic way without damaging the items to be cleaned—which may often be fragile materials, have a cloth body and be expensive and valuable-, which should avoid the operator having to hold the brush or comb against the friction force tending to entrain it in rotation. Such an apparatus should preferably have reasonable weight and size, such as to be easily placed on a bathroom console or on the sink bench at the hairdressers.

SUMMARY OF INVENTION

The invention relates to an apparatus for removing hair from the teeth of a comb or the bristles of a brush, comprising at least a whip extending from at least one rotating shaft for cyclically passing through a comb or brush receiving position, and suction means for creating an air stream in the proximity fo the receiving position, characterized in that each whip is so spaced apart from any other possible whip of a same rotating shaft as not to interfere, in use, therewith, whereby each whip of a same rotating shaft acts on a comb or a brush individually.

In this description and attached claims, the term "whip" is meant to indicate an elongated, essentially filiform, element.

During the rotation of the rotating shaft, the or each whip, hits the comb or brush arranged at the receiving position, catching or breaking any hair entangled among the teeth or the bristles, and the hair or fragment of hair, thus freed, is removed by the suction air stream.

To increase the disentanglement speed, more whips can be provided, for example distributed along one or more circumferences or along a spiral around the rotating shaft.

Preferably, the whips are distributed along an end portion of the at least one rotating shaft.

Moreover, the at least one rotating shaft is preferably horizontally oriented, thus the whips rotate in a vertical plane.

Moreover, preferably, means for collecting the hair removed by the suction means is comprised.

To intensify the disentangling effect, the apparatus preferably comprises a first and a second parallel rotating shafts, provided with at least one respective whip.

Advantageously, moreover, the first and the second shaft are counter-rotating in such directions that the respective whips converge from the receiving position towards the suction air stream. In this way, during the rotation, the whips convey the removed hair towards the air stream, thus reducing the probability of being scattered in the environment.

To limit the overall size of the apparatus and intensify the disentangling action in the central portion of the receiving position, the rotating shafts preferably are at a mutual distance that is essentially equal to the length of the whips.

For the purpose of preventing the whips of the two shafts from interfering with one another during rotation, the whips of the first rotating shaft may then be axially staggered with respect to the whips of the second rotating shaft.

As an alternative, the whips of the first rotating shaft and the whips of the second rotating shaft may extend in a common transversal plane but in out-of-phase radial positions.

By providing flexible whips, the centrifugal acceleration will cause the whips to adopt the maximum radial extension during rotation, still they will be able to bend if hit by the teeth or bristles or by the same body of the comb or brush, thus preventing breakage and/or damage to other parts.

For the same purpose, flexible or non-flexible whips can be mounted as articulated.

As an alternative, each whip may consist of the free end of a continuous thread wound on a reel.

For the purpose of facilitating the cleaning and replacement of the whips, they can be mounted onto removable whip-holder hubs.

Advantageously, the apparatus further has scrapers that are tangential to the rotating shafts and/or to the whip-holder hubs, for preventing hair from winding around them.

Preferably, the apparatus exhibits a containing box-shaped body provided with an aperture suitable to allow the exit of the whips towards the receiving position and the inlet of air of the suction air stream, and provided with aeration splits.

Preferably, moreover, the aperture of the box-shaped body is arranged at its top. Besides being particularly practical in use, such a configuration favours the removal of disentangled hair, which tends to fall due to gravity force.

Moreover, the apparatus may comprise a protective shell at the aperture of the box-shaped body, so as to prevent the risk of injuries, particularly in case of accidental detachment of the whips.

Again for safety reasons, the protective shell preferably has at least one access door urged in the closed position and interacting with a safety switch.

Advantageously, the box-shaped body comprises an extractable drawer-like container for collecting the hair, provided with a hair-retaining filter. In this way, the action of cleaning the filter is facilitated.

For hygiene reasons, the extractable drawer is preferably sealingly closable.

Preferably, moreover, the hair-collecting extractable drawer has a variable height so as to be inserted underneath the motor.

Moreover, to facilitate the cleaning and the possible replacement of the whips, the box-shaped body may have an inspection door at the whips.

Preferably, a common motor is present, typically an electric motor, for operating both a fan of the suction means, and the at least one rotating shaft. Besides limiting the size and the power required by the apparatus, this expedient ensures the simultaneousness of the disentangling and suction actions.

Typically, the apparatus then has first motion transmission means between a driving shaft of the electric motor and the first rotating shaft and second motion transmission means between the first rotating shaft and the second rotating shaft.

The first motion transmission means can consist of a belt drive, preferably at an intermediate portion of the first-rotating shaft.

The second motion transmission means can comprise two gearwheels respectively coupled to the first and to the second rotating shaft and engaged with one another, or two rubber-top pulleys coupled through friction.

Gearwheels or rubber-top pulleys are preferably arranged at an end of the rotating shafts, preferably at the end opposed to that from which the at least one respective whip extends.

BRIEF DESCRIPTION OF DRAWINGS

Further features and advantages will appear more clearly from the description of a preferred but not exclusive embodiment of a cleaning apparatus for hair brushes and combs, illustrated as a non-limitative indication in the attached schematic drawings, wherein.

DETAILED DESCRIPTION

Figure 1:
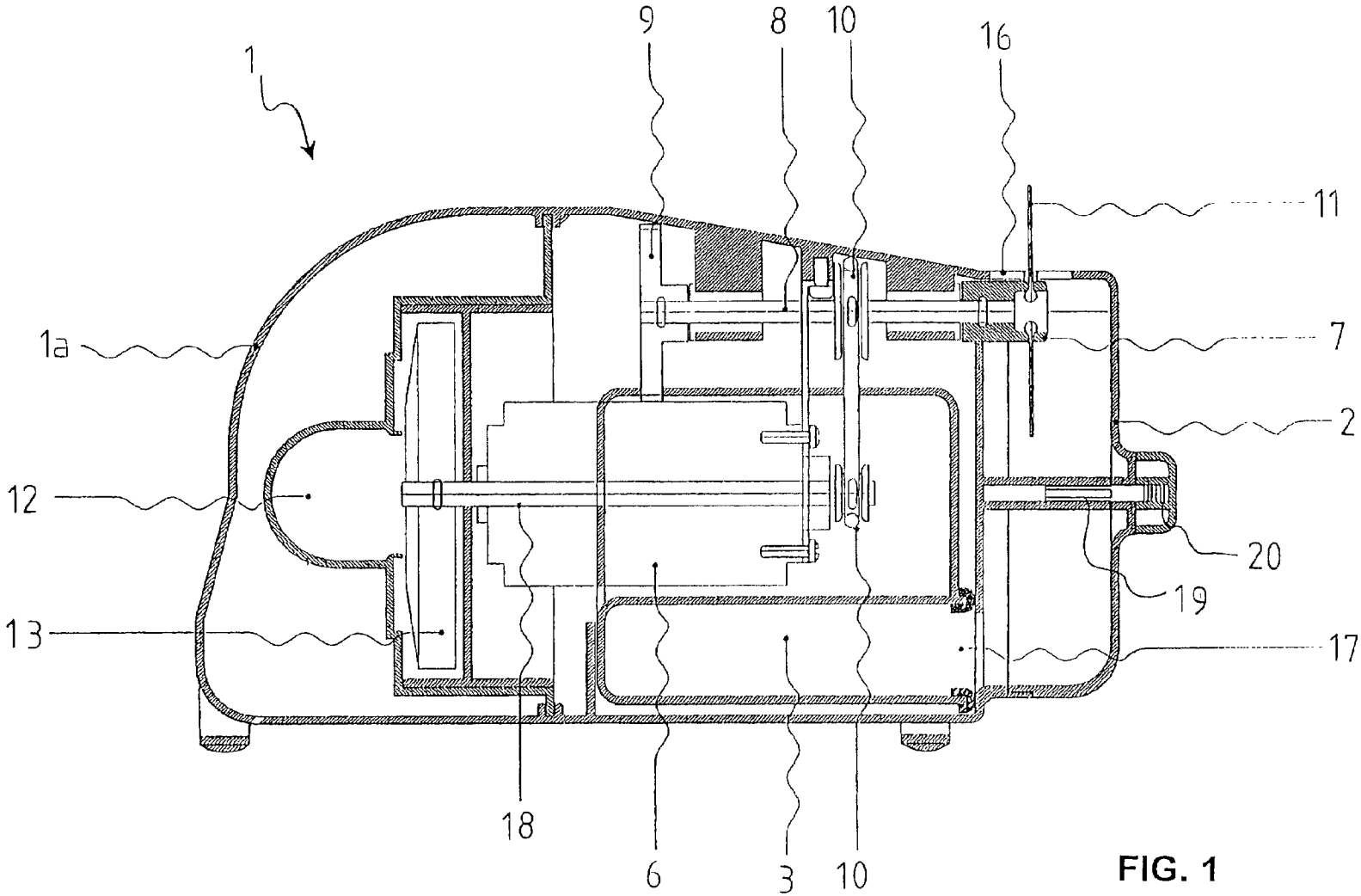
FIG. 1 shows the apparatus according to the invention in longitudinal section (according to line A—A of the following FIG. 6).

Apparatus 1 shown in FIG. 1 comprises a box-shaped body 1*a* enclosing all of the elements suitable to the operation of apparatus 1, such as a motor 6, typically electrical, whose driving shaft 18 provides both to operating a fan 13, and—through a belt drive 10—to operating horizontal shafts 8 coupled through gearwheels 9 at a first end, and carrying, at the opposed end, hubs 7 with respective whips 11.

A whip inspection door 2 is represented as frontally mounted, for example through a screw coupling 19, 20.

On the top, the box-shaped body 1*a* exhibits an aperture 16 suitable to allow the exit of whips 11 during the rotation of shafts 8. Moreover, aperture 16 allows the inlet of air, which is sucked by fan 13 through an air manifold 12 and a passage 17, connected to a preferably extractable drawer-like container 3 for collecting the hair and other removed debris. Thus, between aperture 16 and passage 17 there is defined an essentially vertical suction duct below the rotating shafts 8.

Figure 2:
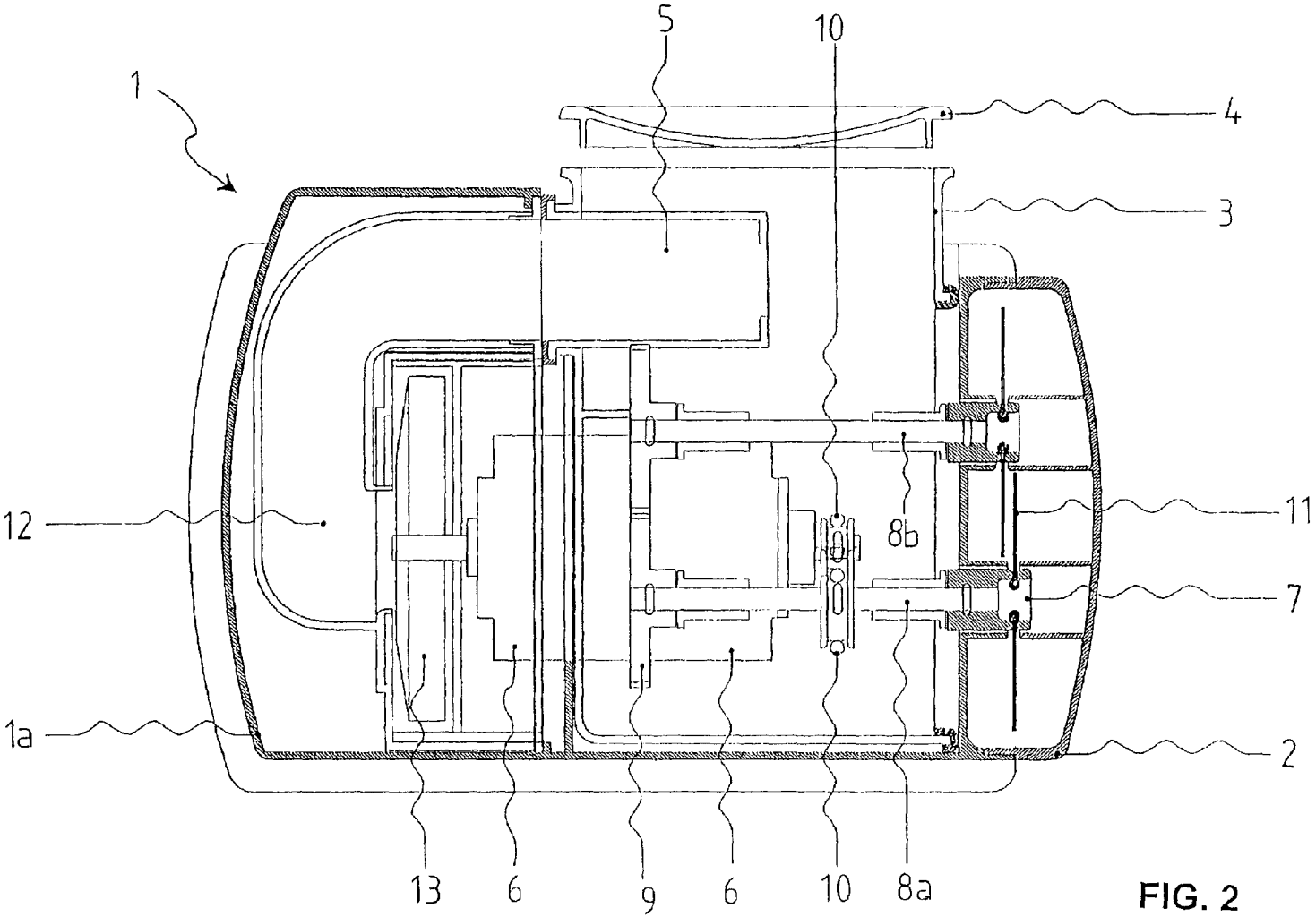
FIG. 2 shows a sectional view in a plane in the proximity of the apparatus top (according to line B—B of the following FIG. 5).

The sectional view of FIG. 2 allows the plan view of the air manifold 12, connected to a filter 5 housed within container 3, in turn sealingly closed by a cover 4, shown as removed from its seat.

Moreover it can be noted that, for the purpose of preventing the whips of the two shafts from interfering with one another during rotation, the whips of the two shafts 8 are axially staggered.

In fact, for limiting the overall size of the apparatus, and intensifying the disentangling action in the central portion of the comb or brush receiving position, the rotating shafts 8 exhibit, as shown, a mutual distance that is essentially equal to the length of whips 11.

As an alternative to the staggering in axial direction, the whips of the first rotating shaft 8*a* and the whips of the second rotating shaft 8*b* could extend in a common transversal plane, but in out-of-phase radial positions.

Figure 3:
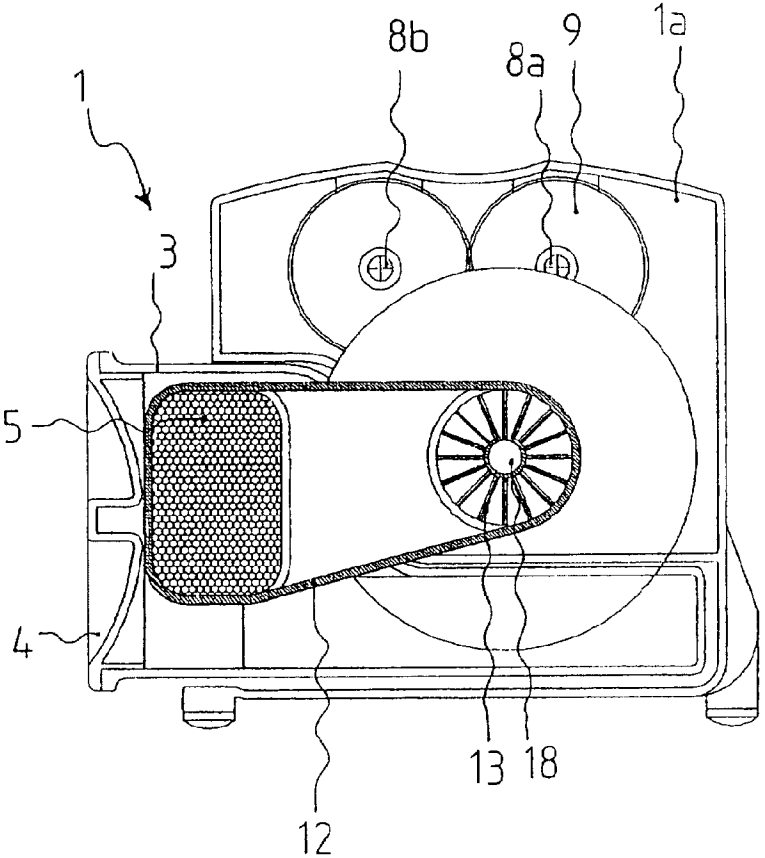
FIG. 3 shows a cross-sectional view in a plane in the proximity of a rear end (according to line C—C of the following FIG. 6).

FIG. 3 represents the side pattern of manifold 12 which, starting from fan 13, reaches filter 5.

Figure 4:
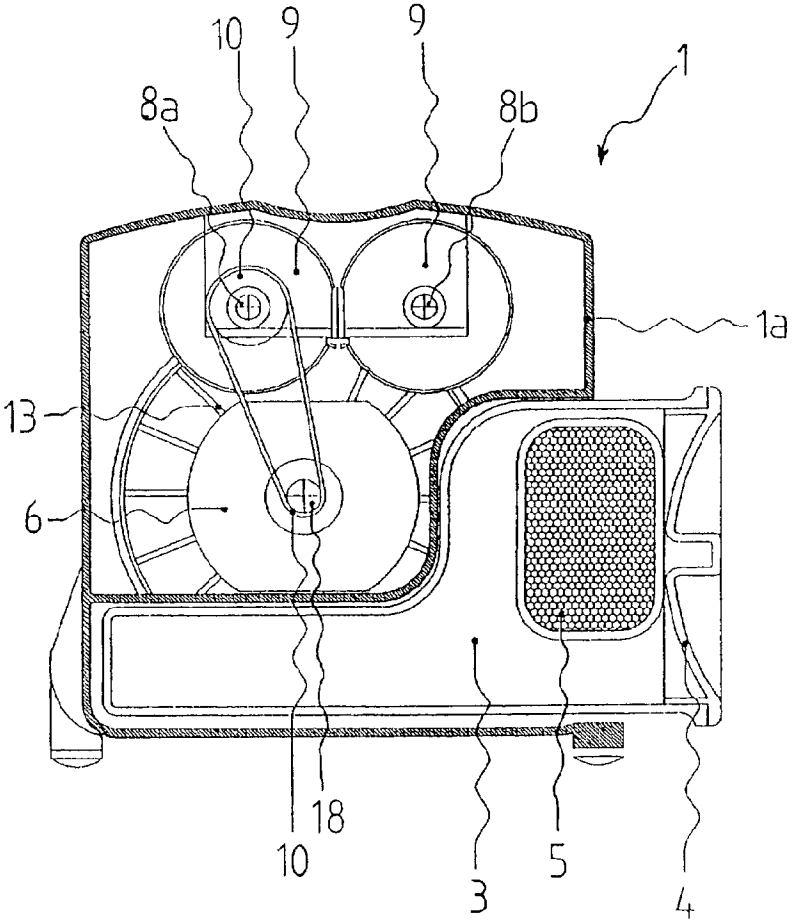
FIG. 4 shows a cross-sectional view in a plane in the proximity of a front end (according to line D—D of the following FIG. 6).

FIG. 4 clarifies the connection between the driving shaft 18, the fan 13 and the rotating shafts 8 through transmission 10 and gearwheels 9.

Moreover, the particular shape of container 3 for collecting the hair is visible, having a variable height so as to be inserted under motor 6.

Figure 5:
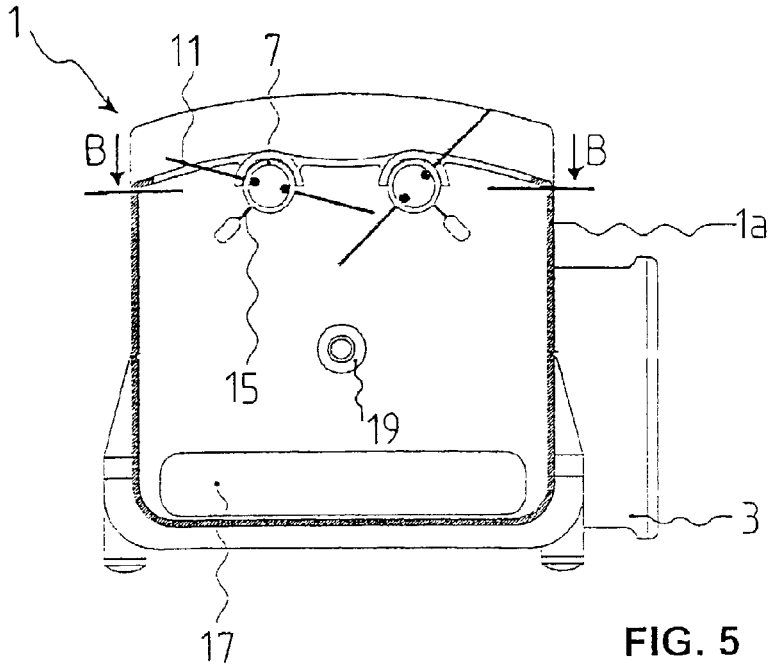
FIG. 5 shows a front view of the apparatus without the whip inspection door.

Moreover, FIG. 5 illustrates scrapers 15 acting at the whip-holder hubs 7 for preventing the winding of hair around the whip-holder hubs 7.

Figure 6:
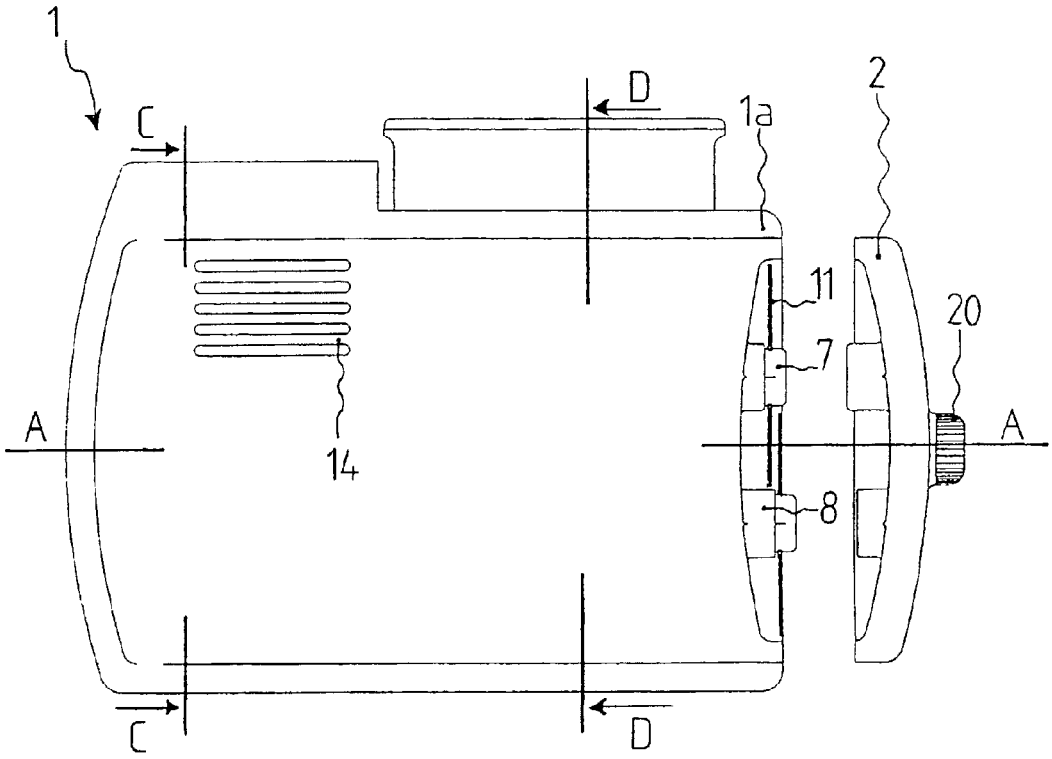
FIG. 6 shows a plan view with the whip inspection door removed.

In FIG. 6 there are visible some aeration slits 14 into the box-shaped body 1*a* for allowing the exit of the sucked air and for motor cooling.

Figure 7:
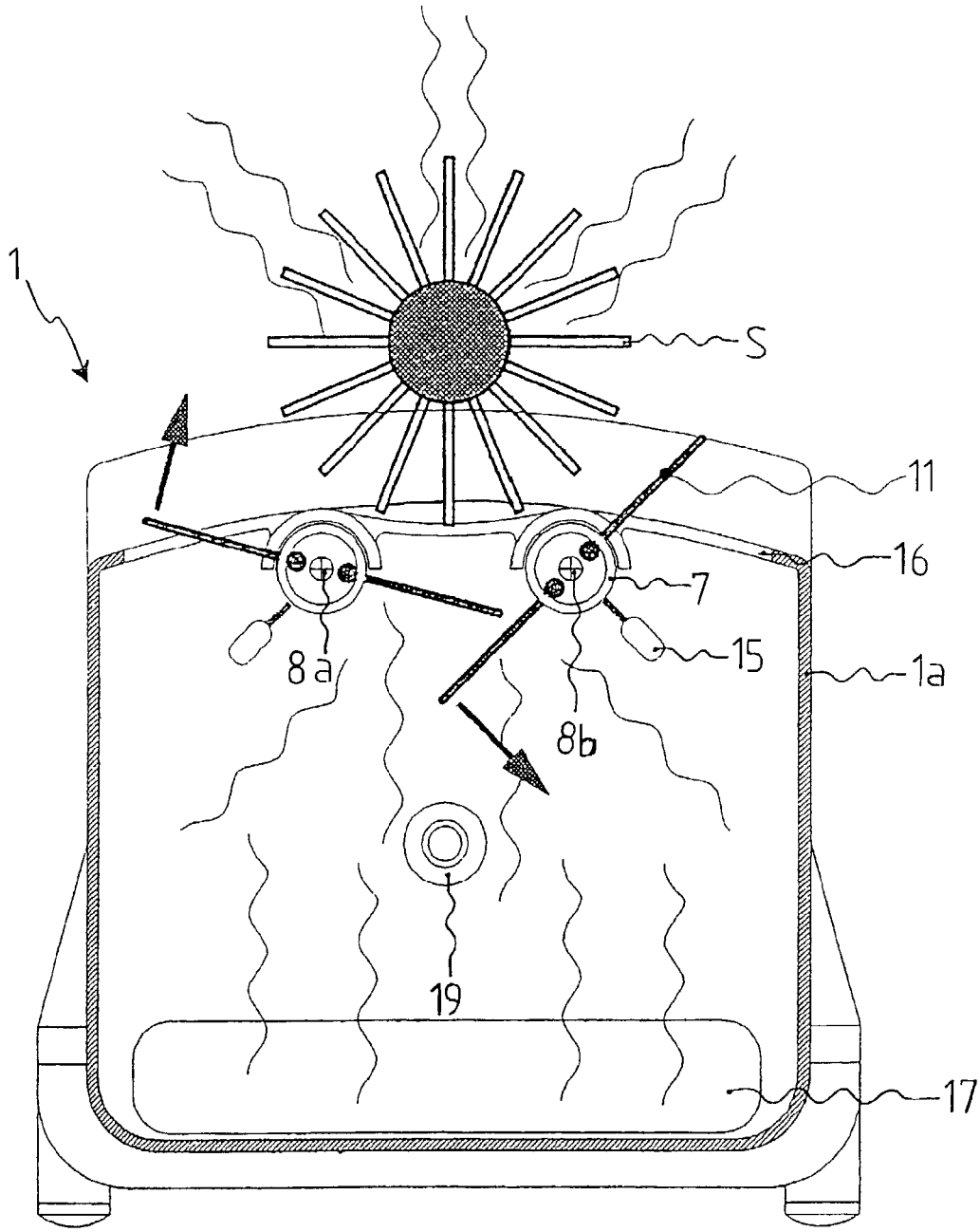
FIGS. 7, 8 and 9 schematically show the operation of the apparatus.
Figure 8:
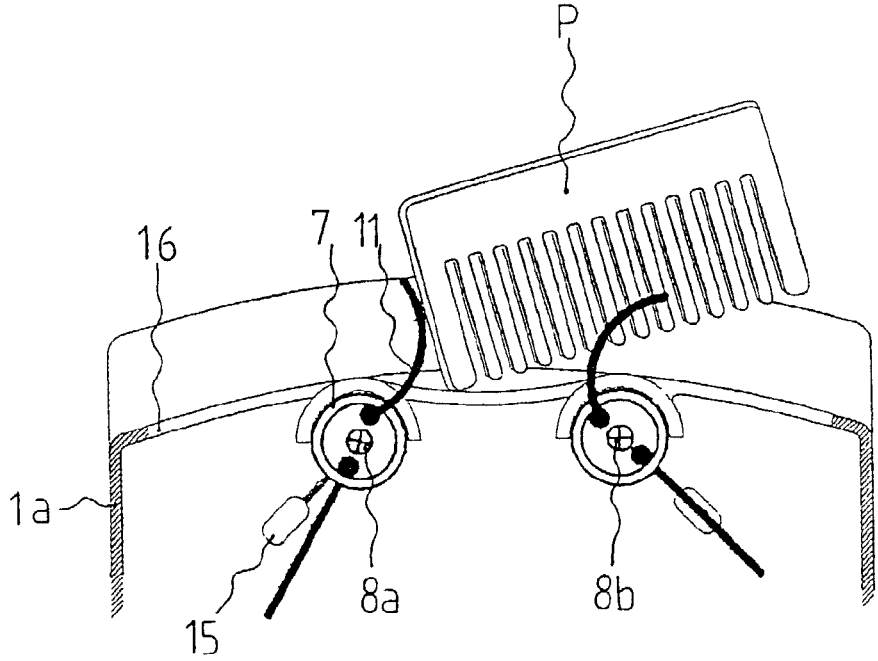
Figure 9:
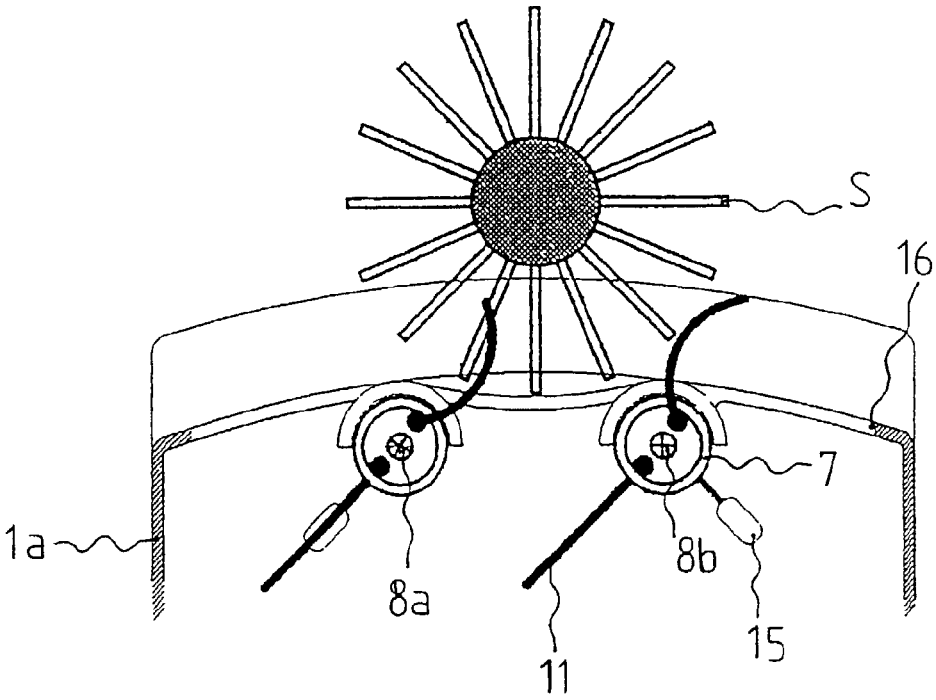

FIGS. 7–9 schematically show the action of the disentangling whips 11.

In FIG. 7, the direction of rotation, indicated by the arrows, and the peripheral extension adopted by whips 11 due to the centrifugal force can be seen. In particular, the rotating shafts 8 are counter-rotating in such directions that the respective whips 11 converge from the receiving position of brush S, centrally above the rotating shafts 8, towards the suction air stream, wherein they convey the hair removed from the bristles of brush S.

FIGS. 8 and 9 illustrate the manner in which the whips 11, capable of flexing, yield when on their path they meet the bristles of a brush S, or respectively, the teeth of a comb P, arranged in the receiving position.

More in detail, the operation of apparatus 1 is as follows.

By acting on the switch (not shown), it is possible to power the electric motor 6 which, in its circular motion, will actuate both the fan 13 and the rotating shafts 8, and thus, whips 11 facing aperture 16 of the box-shaped body 1. The motion of fan 13 within the toric chamber-shaped manifold 12 will cause a continuous air flow within apparatus 1, sucking it through aperture 16, where the disentangling whips 11 act; the sucked air will enter into the drawer-like collecting container 3, passing through the filtrating meshes of filter 5, and it will be discharged clean outside through slits 14.

A condition of continuous suction and discharge is thus stabilised, suitable for collecting and retaining all residuals that come in the proximity of aperture 16, where the disentangling whips 1 act.

The disentangling and cleaning action is performed by whips 11, which during the rotation of rotating shafts 8, cyclically pass through the receiving position of comb P or brush S, in the proximity of aperture 16, where they effectively catch and break the hair and other residues entangled among the bristles of brush S or the teeth of comb P. The motion of shafts 8 and thus, of whips 11 mounted on hubs 7, integral with them, is counter-rotating, that is, the first on the left in FIG. 7 rotates in clockwise direction, and the second rotates in counter-clockwise direction; this allows conveying what removed towards the centre, where the suction air flow does not have difficulty to catch residuals and hair and convey them to the collecting container 3.

It is worth noting that during the rotation of the rotating shafts 8, whips 11 are always dipped in the suction air stream, which favours removal of any hair entangled in the whips 11 themselves.

In the practical implementation of the apparatus of the invention, the most functional whips 11 will be selected in conformity with the tools they have to clean. Thus, they can be rigid or more or less flexible, and/or articulatedly mounted and orbitally mounted on the entrainment hubs 7.

Figure 10:
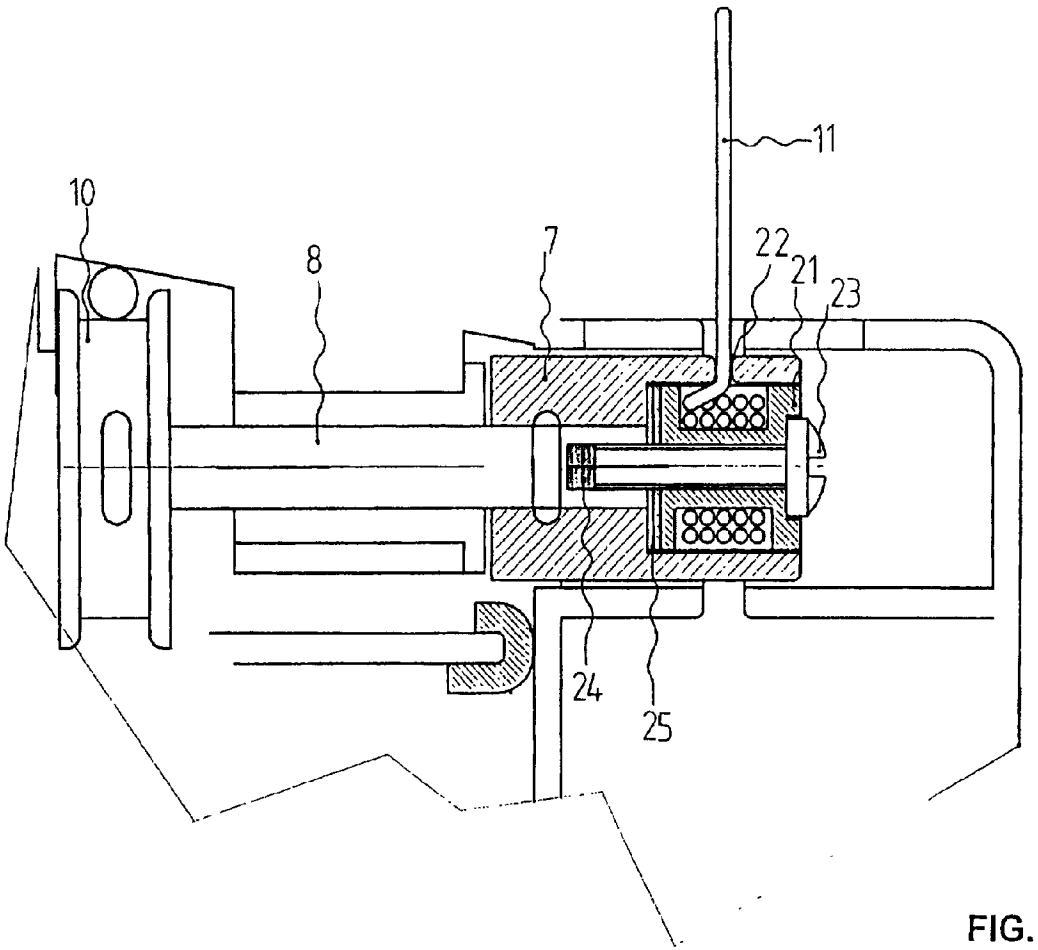
FIG. 10 shows a partial sectional view illustrating an alternative embodiment of whips.

As an alternative, as illustrated in the partial section of FIG. 10, each whip 11 may consist of the free end of a continuous thread, for example an elastic thread, wound on a reel 21. Reel 21 is housed within a coaxial seat of hub 7, with friction disks 25 interposed. Hub 7 has a hole 22 in its side wall so as to allow the exit of whip 11. An adjusting screw 23, provided with an end rubber 24, allows constraining reel 21 with hub 7 and shaft 8 and, when loosened, it allows extracting a new portion of thread to renew whip 11.

Figure 11:
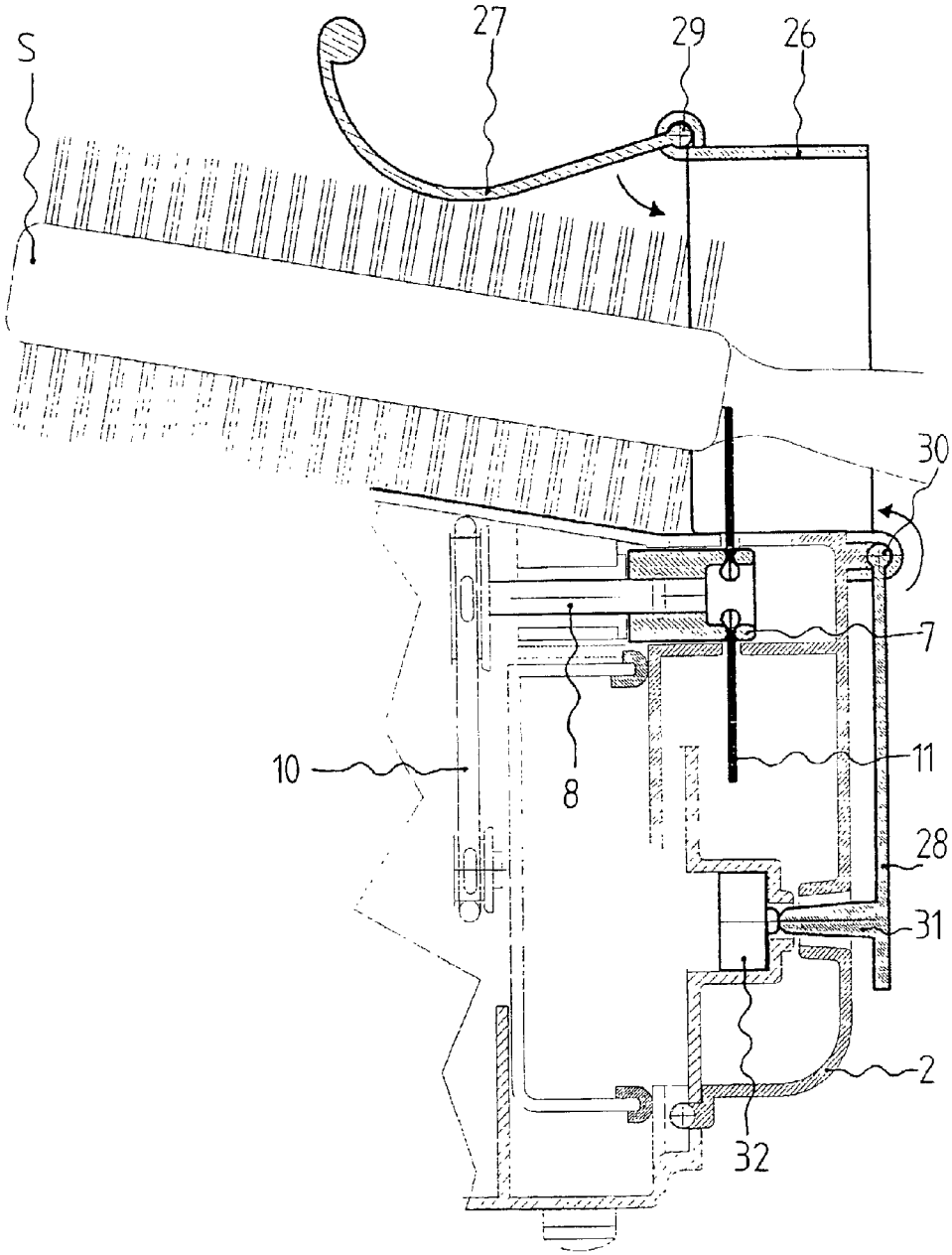
FIG. 11 shows a partial sectional view of a protective shell of the apparatus.

To increase the safety of apparatus 1, moreover, there can be provided, as illustrated in FIG. 11, a protective shell 26 arranged at aperture 16. Since the whips are subject to centrifugal force, in case of detachment of a whip 11 during operation of the apparatus, it would be retained by the protective shell 26.

Moreover, since the receiving position of the comb or of brush S is bounded by the same protective shell 26, the user's hands do not contact the whips.

The protective shell 26 shown in FIG. 11 is provided with a rear access door 27 and with a front access door 28, shown in opened position. Doors 27 and 28 are urged in the closed position of protective shell 26, as shown by the arrows, for example by torsion springs at the hinge points 29, 30.

The front access door 28 exhibits a projection 31 which, in the illustrated opened position, co-operates with a safety switch 32, connected to motor 6 through electrical connections, not shown. The illustrated safety switch 32 is of the push-button type, and it actuates motor 6 only when the front door 28 is held downwards, against the force of the torsion spring at hinge 30. Thus, requiring the use of both hands, apparatus 1 is safe also against the actuation by children.

The invention thus devised can be subject to changes and variants, all falling within the inventive scope. All details can be replaced with other technically suitable elements, in practice, the materials used, provided that they are compatible with the specific use, and the size and the shapes that are contingent to the invention can be of any type according to the requirements.

For example, separate motors could be provided for actuating the fan 13 and the rotating shafts 8, as well as different motion transmission systems. For example, two separate transmissions could be provided for the two rotating shafts 8, and the transmissions can be implemented through gears, belts or rubber-top pulleys coupled through friction.

As regards the number of whips, it can be understood that several embodiments can be devised. In fact, while on the one hand a single rotating shaft with a single whip could suffice, on the other hand the single rotating shaft or each rotating shaft could be provided with more than two whips distributed along a circumference and/or with more axially spaced whips so as to act along the entire length of a brush without having to move it forwards and backwards.

As an alternative to the extractable drawer provided with filter, as hair collecting means it could be possible, for example, to use a collecting bag as those used in vacuum cleaners.

What is claimed is:

1. An apparatus for removing hair from one of teeth of a comb and bristles of a brush, comprising:

a first rotating shaft;

at most two whips extending from the first rotating shaft for cyclically passing through one of a comb receiving position and a brush receiving position; and a suction arrangement generating an air stream in proximity to one of the comb receiving position and the brush receiving position, the air stream sucking the hair from the one of the teeth of the comb and the bristles of the brush, wherein a first whip of the at most two whips is spaced from a second whip of the at most two whips by a predetermined distance so that, during use of the apparatus, the first whip does not interfere with the second whip, the first and second whips acting on one of the comb and the brush individually.

2. The apparatus according to claim 1, further comprising:

a collecting arrangement collecting the hair sucked by the suction arrangement.

3. The apparatus according to claim 1, further comprising:

a second rotating shaft, the second rotating shaft being parallel to the first rotating shaft, the second rotating shaft including a third whip extending therefrom.

4. The apparatus according to claim 3, wherein the first and second rotating shafts rotate in opposite directions so that the first and third whips converge from one of the comb and brush receiving positions towards the air stream.

5. The apparatus according to claim 3, wherein the first and second rotating shafts are separated from one another by a particular distance, the particular distance being substantially equal to a length of the first whip.

6. The apparatus according to claim 1, wherein the first whip is flexible.

7. The apparatus according to claim 1, wherein the first whip is mounted on a whip-holder hub.

8. The apparatus according to claim 1, wherein each of the first and second whips includes a free end of a continuous thread wound on a reel which is attached to the first rotating shaft.

9. The apparatus according to claim 3, wherein the first and second whips are mounted on respective removable whip-holder hubs.

10. The apparatus according to claim 9, further comprising:

a plurality of scrapers situated tangentially to at least one of the first and second rotating shafts and the respective whip-holder hubs.

11. The apparatus according to claim 1, further comprising:

a box-shaped body, the body having an aperture through which the first whip extends toward one of the comb receiving position and the brush receiving position, the aperture providing an inlet of air for the air stream, the body having aeration slits.

12. The apparatus according to claim 11, wherein the aperture is located at a top side of the box-shaped body.

13. The apparatus according to claim 11, further comprising:

a protective shell situated at the aperture.

14. The apparatus according to claim 13, wherein the protective shell has an access door urged toward a closed position, the protective shell interacting with a safety switch.

15. The apparatus according to claim 11, wherein the box-shaped body includes an extractable drawer-like container collecting the hair, the container including a hair-retaining filter.

16. The apparatus according to claim 11, wherein the box-shaped body includes an inspection door positioned as a function of a position of the first whip.

17. The apparatus according to claim 1, further comprising:

a motor capable of operating a fan of the suction arrangement and the first rotating shaft.

18. The apparatus according to claim 3, further comprising:

a motor capable of operating a fan of the suction arrangement and the first rotating shaft;

a first motion transmission arrangement situated between a driving shaft of the motor and the first rotating shaft; and a second motion transmission arrangement situated between the first and second rotating shafts.

19. An apparatus for removing hair from one of teeth of a comb and bristles of a brush, comprising:

a first rotating shaft;

a plurality of whips extending from only one of an end and an area adjacent the end of the first rotating shaft for cyclically passing through one of a comb receiving position and a brush receiving position; and a suction arrangement generating an air stream in proximity to one of the comb receiving position and the brush receiving position, the air stream sucking the hair from the one of the teeth of the comb and the bristles of the brush, wherein a first whip of the plurality of whips is spaced from a second whip of the plurality of whips by a predetermined distance so that, during use of the apparatus, the first whip does not interfere with the second whip, the first and second whips acting on one of the comb and the brush individually.

* * * * *